US005477594A

United States Patent [19]

LePage

[11] Patent Number: 5,477,594

[45] Date of Patent: Dec. 26, 1995

[54] NICHE PANEL

[75] Inventor: Bernard E. LePage, Rochester Hills, Mich.

[73] Assignee: Christian Memorial Cultural Center, Rochester Hills, Mich.

[21] Appl. No.: 174,989

[22] Filed: Dec. 29, 1993

[51] Int. Cl.[6] ..... A47F 5/00

[52] U.S. Cl. ..... 27/1; 211/84; 211/194; 312/108; 312/111

[58] Field of Search ..... 27/1; 52/79.5, 52/79.9, 79.13, 802, 810; 312/108, 111, 117, 128, 138.1, 140, 257.1, 263, 264, 270.1, 134; 211/84, 194; 403/176

[56] References Cited

U.S. PATENT DOCUMENTS

| | | | |
|---|---|---|---|
| 2,513,951 | 7/1950 | McClellen | 27/1 |
| 2,752,215 | 6/1956 | Peiss | 312/111 X |
| 3,076,292 | 2/1963 | Arbogast | 50/92 |
| 3,183,574 | 5/1965 | Diem | 27/1 |
| 3,254,773 | 6/1966 | Diem | 211/71 |
| 3,486,287 | 12/1969 | Guillon | 52/495 |
| 3,529,730 | 9/1970 | Thompson | 211/71 |
| 3,661,434 | 5/1972 | Alster | 312/111 |
| 3,751,127 | 8/1973 | Black | 312/111 |
| 3,754,805 | 8/1973 | Pangburn et al. | 312/111 |
| 3,836,218 | 9/1974 | Hallal | 312/111 |
| 3,841,726 | 10/1974 | Andros | 312/111 |
| 3,888,055 | 6/1975 | Gallo | 52/98 |
| 3,905,169 | 9/1975 | Gallo | 52/137 |
| 3,975,877 | 8/1976 | Walton | 52/282 |
| 4,073,100 | 2/1978 | DiGiovanni, Jr. | 52/79.3 |
| 4,301,636 | 11/1981 | Luria | 312/111 |
| 4,470,647 | 9/1984 | Bishoff et al. | 312/111 |
| 4,592,601 | 6/1986 | Hlinsky et al. | 312/111 |
| 4,614,066 | 9/1986 | Koppenberg | 52/134 |
| 4,617,777 | 10/1986 | Fonne et al. | 52/802 |
| 4,782,637 | 11/1988 | Eriksson et al. | 312/111 X |
| 4,967,532 | 11/1990 | Castle et al. | 52/802 X |
| 5,195,812 | 3/1993 | Eickhof | 312/257.1 |
| 5,243,794 | 9/1993 | Pikor | 52/136 |

*Primary Examiner*—Carl D. Friedman
*Assistant Examiner*—Beth A. Aubrey
*Attorney, Agent, or Firm*—Basile and Hanlon

[57] ABSTRACT

A modular urn holder comprising a niche panel made of polymer material whereby each niche panel is convertible to be used as a top wall, a bottom wall, and a side wall of the urn holder. Niche panels are connected together by corner connectors that slidably connect to the ends of the panels. The niche panel comprises two panel members that are snap-fit together to provide for the hollow panel. Each panel is molded to contain recesses to allow shelves to slidably engage within the recesses to subdivide the niche into smaller compartments. The niche is adaptable to accept varying types of front shutters.

4 Claims, 4 Drawing Sheets

NICHE PANEL

FIELD OF THE INVENTION

This invention relates to an urn storage module for the interment of cremated remains and, in particular, to a niche panel for providing side, top and bottom walls for the module.

BACKGROUND OF THE INVENTION

Cremation of deceased loved ones has become a common practice as it provides a significant reduction in the storage requirements for interment of the remains. Until recently, most urn storage units were constructed of concrete, which did not provide for an easily transportable unit once manufactured, thereby adding a significant cost in shipping. Columbariums or urn storage units provide long term storage for urns holding cremated human remains. In many cases, columbariums are located outside and therefore exposed to the elements. Therefore, construction of a columbarium must be durable and weather-tight. In the last 20 years efforts have been made to use other material in the construction of columbariums such as fiberglass and plastic. In addition to making the urn storage units lightweight, plastic provides versatility by allowing varying size storage niches. One such design is disclosed in U.S. Pat. No. 3,754,805 issued to Pangburn, et al.. The Pangburn disclosure is an urn storage assembly having a plurality of tubular storage members of generally rectangular cross-section, shaped to receive cremated remain storage urns. The storage members are nested in abutting side-by-side and top-to-bottom relationship to one another. The storage members are held together by securing means which engage the end corner portions of adjacent storage members. Although this disclosure provides an assembly that can be expanded, it does not provide an assembly that can be efficiently transported.

A design disclosed in U.S. Pat. No. 5,195,812 issued to Eickhof on Mar. 23, 1993, discloses a framework using planar risers having brackets to support lightweight shelving. The risers are connected to tie rods. Additional hardware is needed to attach and anchor the framework to the next support structure. This disclosure does not provide for an urn support that is easily assembled.

SUMMARY OF THE INVENTION

The present invention addresses and solves the problems enumerated above. The present invention is a versatile modular niche panel that assembles to provide a plurality of individual niches for the containment of urns. The assembly comprises a panel member that can be used for top, bottom, and side surfaces of the niche. Each panel and shelf is constructed of two lightweight members that snap fit together to form a hollow structure. Metal strips may be added along the perimeter of each panel between the hollow halves of the members to provide extra rigidity to the panel frame. Each panel has recesses for dividing the niche panel into smaller compartments. A set of niche panels can be the resting place for one or more cremated remains. Partitions can be added or deleted by adding or removing shelves at any time. Shelf members can be slid into the recesses to provide the multiple niches. A back panel is constructed in a similar manner as the shelves. It is fastened to the niche panel by screw connectors. The front shutter may also be constructed as the back panels, but in addition, the niche panel is adaptable to accept a glass, marble or other decorative stone front shutter.

A corner connector holds the perpendicular panels together. The corner connector is an aluminum bar having a somewhat snowflake design cross-section. The corner connector slides into grooves running along the side lengths of each panel. Additional niche panels may be connected to an existing niche by abutting the new panels to the niche and sliding the grooved ends of each panel through the corner connector.

As a result of the niche using a minimum number of parts, the construction of the niche saves cost in manufacturing and material, and saves manpower time in production and in assembly. The material of the niche is lightweight and therefore the panels can be transported in sheets to save space and transport costs. Finally, the niche accommodates a variety of decorative front shutters to satisfy the customers' wishes.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
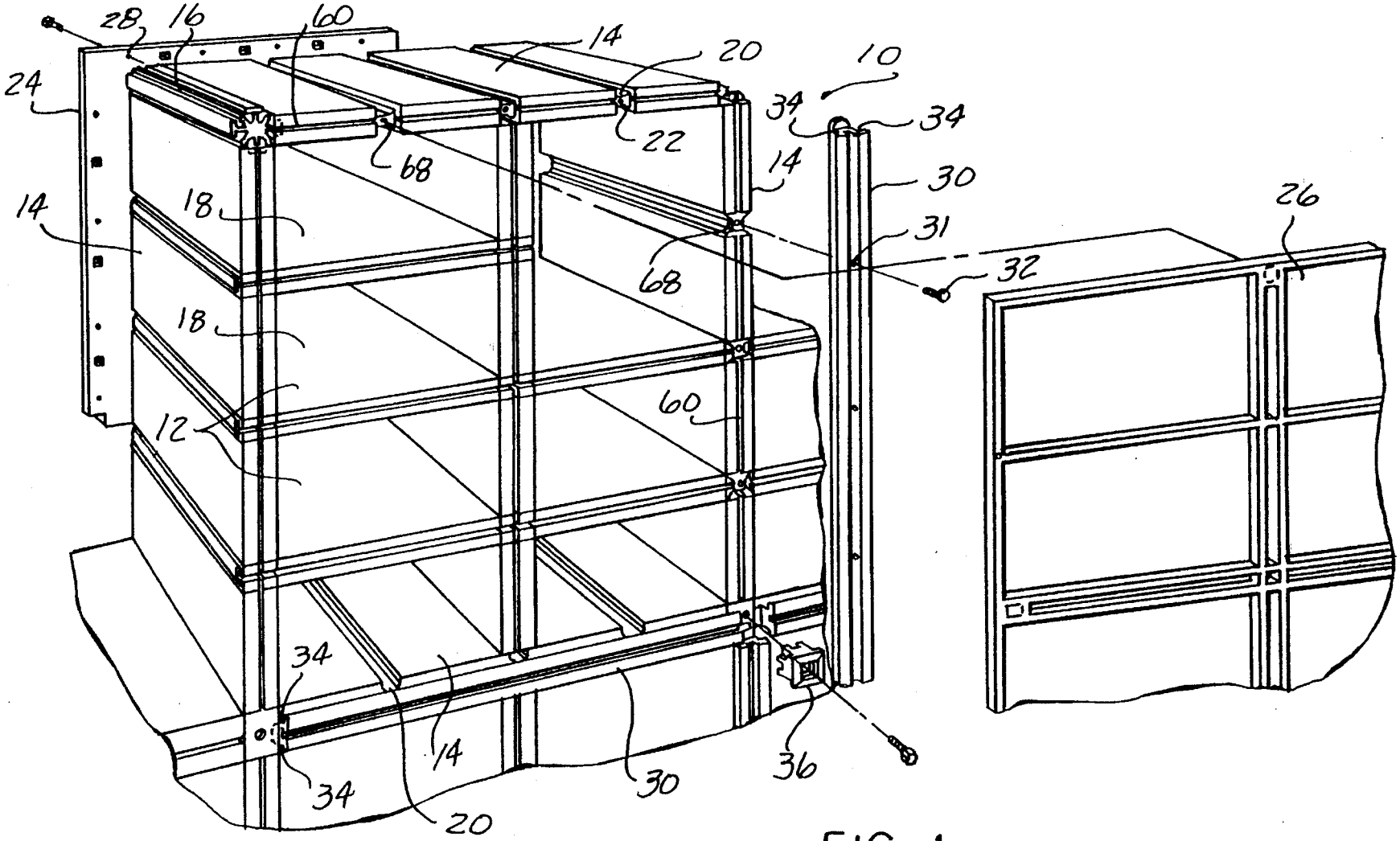
FIG. 1 is a perspective view of a niche assembly embodying the present invention.

The subject invention is a modular niche assembly or urn storage assembly and is generally shown at 10 in FIG. 1. The assembly 10 includes a plurality of individual urn chambers 12 for receiving remains therein. The assembly 10 comprises four interconnected niche panels 14 connecting with each other at their corners by a corner connector 16. The individual niche panels 14 may be interconnected laterally and longitudinally to form a planar surface and be stacked upon one another forming vertical and horizontal columns. One set of four niche panels 14 forming top, bottom, and sides of a niche 10 provides for 1 to 16 compartments. The niche 10 can be sub-divided by means of shelves 18 when inserted vertically or horizontally. Each niche panel 14 contains three evenly spaced recessed areas 20 running the length of the niche panel 14. The recessed areas 20 allow a shelf 18 to slide within the recess 20 to form a co-planar panel. In the preferred embodiment, apertures 22 are located at ends of each niche panel 14 in the recessed area. These apertures 22 are provided to threadably attach back 24 and front 26 panels, or various decorative trim.

The back panel 24 is a generally flat surface which can be made of any material, but preferably a polymer material. The back panel 24 has apertures 28 spaced about the perimeter of back panel 24 to coincide with apertures 22 for threadably attaching thereon by conventional means.

Decorative aluminum trim 30 can be placed along the front edges of the four sides of the niche panel 14 before attaching a front shutter 26. The decorative trim 30 is secured to the panel edges by screws 32 through apertures 31 or other known methods. The aluminum decorative trim 30 is a strip the length of a panel side. The preferred shape of the trim 30 is a flattened U-shape so that when the trim 30 is attached, the trim 30 provides a channel 34 for securing the shutter 26. A large rosette 36 can be inserted at each corner of the panel adjacent to the decorative trim 30 to hide the ends of the trim 30 and any exposed panel edge.

Once the two sides and the bottom decorative trim 30 are attached to the niche panels 14, a lightweight shutter 26 made of the same material as the niche panel 14 or glass may be slid from the top down to the bottom panel edge in the channel 34 provided by the decorative trim 30.

Figure 2:
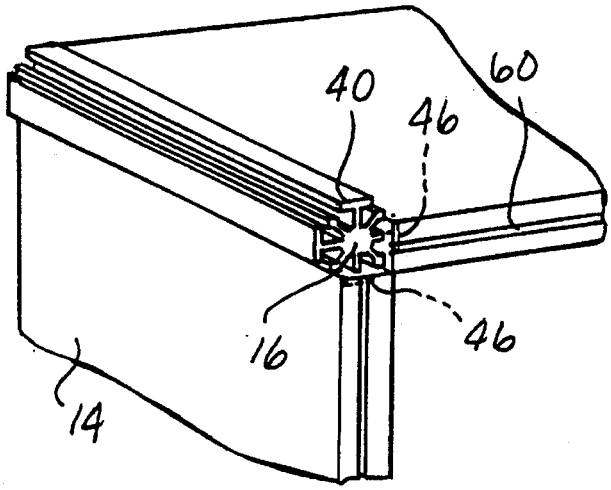
FIG. 2 is a perspective view of a corner connector forming part of the present invention.
Figure 7:
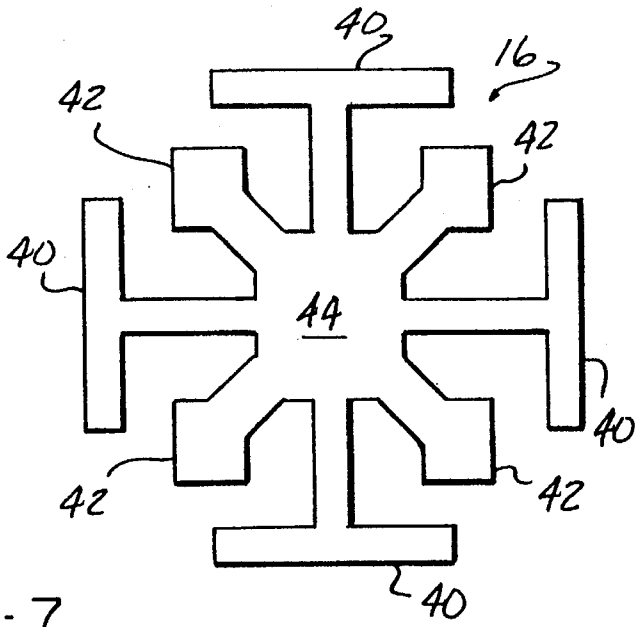
FIG. 7 is an end view of the corner connector.

As seen in FIG. 1 and more clearly in FIG. 2, each niche panel 14 is connected to another adjacent niche panel 14 by a corner connector 16. The corner connector 16 is a solid aluminum bar cut out lengthwise and having a cross-section in a somewhat snowflake-shape pattern. As seen in FIG. 7, the snowflake pattern consists of four mutually perpendicular T-bars 40 alternating between four mutually perpendicular diamond points 42. The T-bars 40 and diamond points 42 have a common center intersecting area 44. To connect a pair of panels at a corner, a T-bar 40 end fits into a coinciding T-shaped cut-out groove 46 along sides of the niche panel 14. The corner connector 16 slides into place and snugly holds the niche panel 14 together. The T-bar 40 locks the niche panel 14 to the corner connector 16. The diamond point 42 forms a 90° angle to extend and square off the planar surface of the niche panel 14. The corner connector 16 is shorter than the length of the niche panel 14 sides, as shown in FIGS. 1 and 2, permitting sufficient clearance for the insertion of rosettes 36 or other decorative trim. Since the T-shaped bar 40 is located uniformly along all four sides of the corner connector 16, the connector 16 is not limited to insertion at a specific edge. Moreover, the uniform shape of connector 16 allows for extension of the niche panels 14 adjacent to existing niche panels 14 in both horizontal and vertical directions, thereby allowing no limit of the number of niches 10 that can be connected. The T-bar 40 located in the coinciding T-shaped grooves 46 locks the connector 16 and niche panels 14 together making it extremely resistant to collapse under the affects of weight, pressure or impact.

Figure 3:
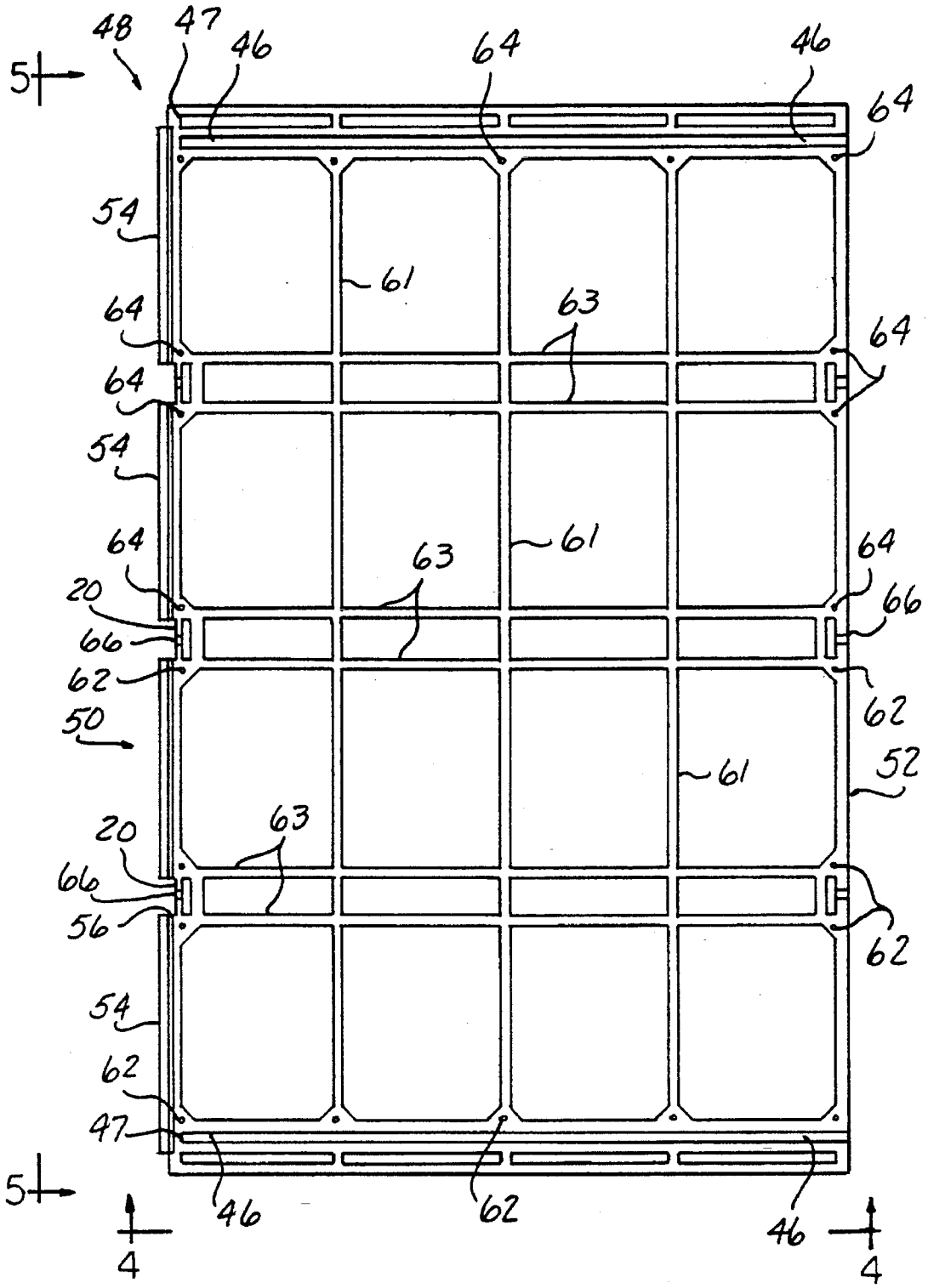
FIG. 3 is a plan view of an interior of a panel member.

Each niche panel 14 is made from two identical panel members 48 that are snap-fitted together to construct the hollow 13 niche panel 14. FIG. 3 shows one such panel member 48. The panel member 48 has a front end 50 and a back end 52. The front end 50 is distinguished from the back end 52 in that the front end 50 has a raised layer 54 so that a groove 56 is formed for the placement of a brass or other decorative strip 58 to conceal a gap 60 (FIG. 1 and FIG. 5) formed when two panel members 48 are joined together. Spaced around the perimeter of each panel member 48 are pins 62 and holes 64. Half of the perimeter has pins 62 and half has holes 64 spaced along the perimeter in mirror image location of the pins 62. Therefore, when assembling the niche panels 14, one panel member 48 will be turned so that the holes 64 will be matched with the pins 62 on the other panel members 48 for insertion therein. Vertical ribs 61 and horizontal ribs 63 traverse the interior of the panel member 48 to provide added strength.

Each panel member 48 is preferably a lightweight plastic material. In the preferred embodiment, longitudinal and latitudinal metal strips can be spaced within the interior side of each panel member 48 to provide added strength to the perimeter of the niche panel 14. Half circular dowel holes 66 are provided within the recessed area 20 between the raised layer 54 of the front end 50 so that when two panel members 48 are connected to form the hollow 13 niche panel 14, a dowel hole 66 is located to allow for attachment of rosettes 36 or other decorative trim 30. The dowel holes 66 are also located in the back end 52 for threadably securing the back panel 24 to the niche assembly 10. At each side end of the panel member 48, a groove 46 to the back end 52 is provided to allow the corner connector 16 to slidingly attach itself to the niche panel 14. The groove 46 stops at a point 47 close to, but spaced from the front end 50 so that the aluminum connector bar 16 is not visible from the front.

Figure 6:
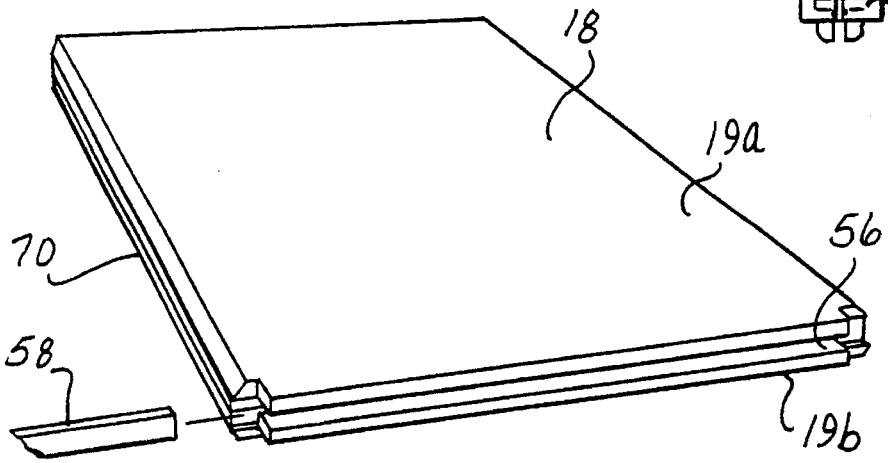
FIG. 6 is a perspective view of a shelf for the present invention.
Figure 4:
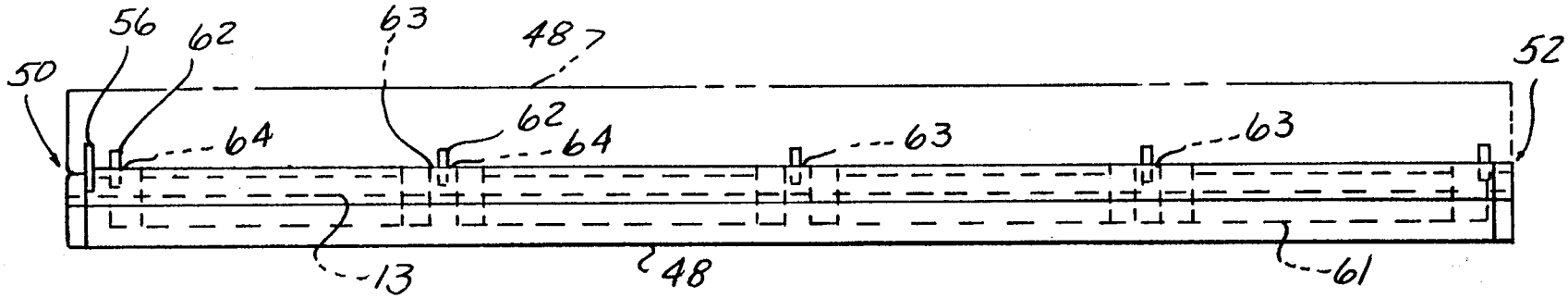
FIG. 4 is a side view of the panel member as seen along lines 4—4 in FIG. 3, in phantom is another panel member snap-fitted to complete the niche panel.

FIG. 4 is a side view of the panel member 48. A second panel member 48 is shown in phantom to indicate how the pins 62 and holes 64 coincide and match to snap-fit two panel members 48 together to form the hollow 13 niche panel 14. For added durability, the panel members 48 may also be glued together. The groove 56 in each panel member 48 at the front end 50 when mated with its corresponding opposite panel member 48 form a housing for a decorative brass strip 58. A decorative strip 58 is shown in FIG. 6.

Figure 5:
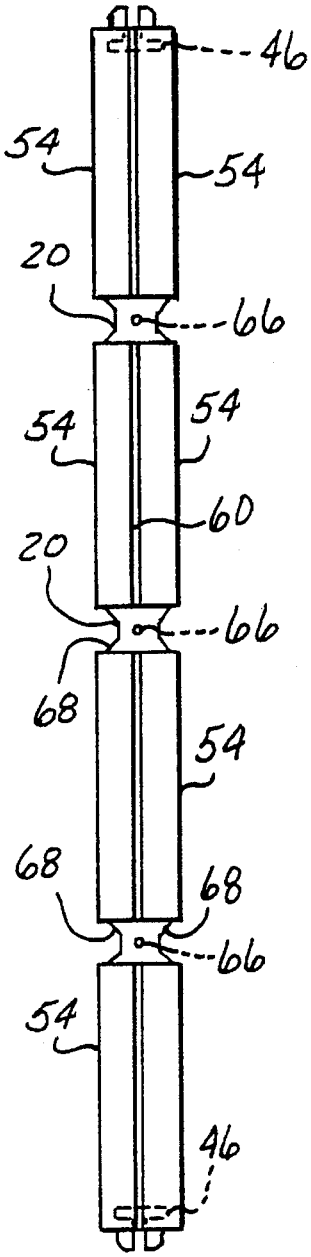
FIG. 5 is a side view of the panel member as seen along line 5—5 in FIG. 3, showing a second panel member snap-fitted to complete a full panel.

FIG. 5 is a view of the front end 50 of two panel members 48 connected to form the niche panel 14. Interspaced between four raised panels 54 are three recessed areas 20. The recessed areas form a U-shaped groove 68 on the top and bottom surfaces of the recessed area 20. The U-shaped groove 68 extend along the length of the niche panel 14 and are provide for receiving similarly shaped outward surfaces 70 of a shelf 18. The shelf 18 is shown in FIG. 6. As shown, the side of each shelf 18 has outwardly bowed ends 70 that are adaptable for sliding within the U-shaped grooves 68 of the niche panels 14. The shelves 18 are also hollow members formed by two members 19*a*, 19*b* snap-fitted or otherwise glued or attached together to form the shelf 18. The front of the shelf 18 also has a similar groove 56 as the panel member 14 to allow for the insertion of a brass plate or strip 58 for decorative means.

In assembly two panel member 48 snap fit together or are attached by other conventional means to form the lightweight yet durable niche panel 14. Each niche panel 14 can be used for either a top, bottom, or sides of the niche assembly 10. The ends of each panel are held together by a corner connector 16 that slidably inserts into a corresponding groove 46 along the panel sides. Each niche panel 14 contains three equidistantly spaced recesses 20 for slidably inserting shelves 18 in the vertical or horizontal direction to partition the niche panel assembly 10 into smaller units. The niche panel assembly can be increased by simply sliding additional niche panels 14 onto exposed T-bars 40 on the corner connector 16 adjacent to an existing niche assembly 10.

Figure 8:
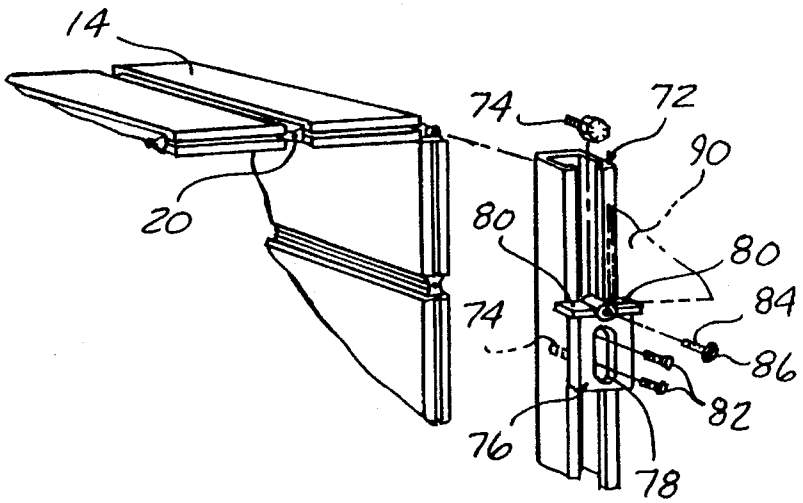
FIG. 8 is a partial view showing a means for securing a heavy front shutter to the niche assembly.

The niche panel assembly 10 is adaptable to secure any type of decorative shutter desired by the family of the deceased. In addition to the decorative trim 30 used to support a lightweight front shutter 26, the assembly 10 can also support a front shutter 26 made of heavy marble or other stone. Looking at FIG. 8, a known means for supporting heavy shutters includes a C-channel bar 72 attached along the niche panel 14 edges in place of the decorative trim 30. Two spring nuts 74 slide into the C-channel bar 72. A hanger 76 having a center aperture 78 and a hanger shelf 80 sits outside of the C-channel so that the center aperture 78 exposes the two spring nuts 74. The hanger 76 is threadably secured to the C-channel bar by bolts 82. A corner of the stone shutter 90 rests against or on the hanger shelf 80 and is securely attached in place by a large washer 84. The washer 84 can have a large decorative head 86 for aesthetic purposes; and strips of brass or other decorative trim may also be inserted to hide the exposed C-channel. The hanger 76 may be set anywhere along the C-channel bar 72 so that the stone shutter 90 optionally encloses a portion or the entire niche panel assembly 10.

It should be clearly apparent that the niche panel assembly 10 of this invention provides versatility and simplicity. The invention is cost effective to manufacture and requires minimal hardware to assemble.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. The urn storage assembly for the interment of cremated remains comprising:

a hollow niche panel adapted for use as a vertical and horizontal side of the storage assembly, said hollow niche panel having a front end, a back end, and two side ends, and comprising two panel members attached together to form said hollow niche panel;

a corner connector slidably attaching to side ends of said hollow niche panels, wherein a plurality of niche panels can be connected to form the urn storage assembly;

a back panel; and a front shutter;

wherein the corner connector comprises a solid bar cut out lengthwise and having a cross-section snowflake pattern, said pattern having four mutually perpendicular T-bars alternating therebetween four mutually perpendicular diamond points, and having a common center intersecting area, said corner connector having a length less than the length of the side ends to permit insertion of decorative trim, wherein each diamond point forms a right angle such that each diamond point extends and squares the side ends of the hollow niche panels.

2. The urn storage assembly for the interment of cremated remains comprising:

a hollow niche panel adapted for use as a vertical and horizontal side of the storage assembly, said hollow niche panel having a front end, a back end, and two side ends, and comprising two panel members attached together to form said hollow niche panel;

a corner connector slidably attaching to side ends of said hollow niche panels, wherein a plurality of niche panels can be connected to form the urn storage assembly;

a back panel; and a front shutter;

wherein the corner connector comprises a solid bar cut out lengthwise and having a cross-section snowflake pattern, said pattern having four mutually perpendicular T-bars alternating therebetween four mutually perpendicular diamond points, and having a common center intersecting area, said corner connector having a length less than the length of the side ends to permit insertion of decorative trim, wherein each diamond point forms a right angle such that each diamond point extends and squares the side ends of the hollow niche panels, and wherein the niche panel has T-shaped grooves along the side ends adaptable for slidably receiving the T-bars of the corner connector.

3. An urn storage assembly for the interment of cremated remains comprising:

a hollow niche panel formed by two panel members attached together, said hollow niche panel adapted for use as a vertical and horizontal side of the storage assembly, said niche panel having a front end, a back end, and two side ends, said side ends having T-shaped grooves, said front end having a raised layer forming a narrow groove for placement of a decorative strip, said panel member having a perimeter wherein one-half of the perimeter has apertures and another half of the perimeter has pins, the apertures being spaced for receiving the pins from another panel member to mate the two panel members to form the hollow niche panel, said panel member including a surface having vertical and horizontal ribs traversing the surface, wherein the ribs are disposed between the two panel members when forming the hollow niche panel;

a corner connector slidably attaching to side ends of said hollow niche panels, said corner connector comprising a solid bar cut out lengthwise and having a cross-section snowflake pattern, said pattern having four mutually perpendicular T-bars alternating therebetween four mutually perpendicular diamond points, said T-shaped grooves adaptable for slidably receiving the T-bars, said diamond points forming right angles to extend and square the side ends of the niche panels, said corner connector having a length less than the length of the side ends to permit insertion of decorative trim; and a hollow shelf formed from two planar members.

4. An urn storage assembly as described in claim 3 wherein the hollow niche panel further comprises recesses for slidably receiving the hollow shelf.

* * * * *